US007225775B2

(12) United States Patent
Ogawa

(10) Patent No.: US 7,225,775 B2
(45) Date of Patent: Jun. 5, 2007

(54) FLUID SUPPLY APPARATUS

(75) Inventor: Kazumi Ogawa, Toyota (JP)

(73) Assignee: Aisin Seiki Kabushiki Kaisha, Aichi-ken (JP)

( * ) Notice: Subject to any disclaimer, the term of this patent is extended or adjusted under 35 U.S.C. 154(b) by 0 days.

(21) Appl. No.: 11/367,458

(22) Filed: Mar. 6, 2006

(65) Prior Publication Data

US 2006/0213471 A1 Sep. 28, 2006

(30) Foreign Application Priority Data

Mar. 22, 2005 (JP) ..... 2005-081333

(51) Int. Cl.
*F01L 1/34* (2006.01)

(52) U.S. Cl. ..... 123/90.17; 123/90.15; 123/90.12

(58) Field of Classification Search ..... 123/90.12, 123/90.13, 90.15, 90.17
See application file for complete search history.

(56) References Cited

U.S. PATENT DOCUMENTS 3,724,294 A 4/1973 Gaus
5,193,494 A 3/1993 Sono et al.
6,085,708 A 7/2000 Trzmiel et al.
6,701,877 B1 * 3/2004 Ottersbach et al. ..... 123/90.17
2002/0104496 A1 8/2002 Sakuragi et al.
2003/0213442 A1 * 11/2003 Cornell et al.
2004/0222319 A1 11/2004 Schmidt et al.

FOREIGN PATENT DOCUMENTS

JP 55086946 A * 7/1980
JP 2001-289014 1/2001

* cited by examiner

*Primary Examiner*—Ching Chang
(74) *Attorney, Agent, or Firm*—Reed Smith LLP; Stanley P. Fisher, Esq.; Juan Carlos A. Marquez, Esq.

(57) ABSTRACT

A fluid supply apparatus includes a fluid pump for supplying a fluid to a fluid supplied portion from a fluid storage portion, a pair of passages provided between the fluid storage portion and the fluid supplied portion in series with the fluid pump, one of the pair of passages including a first supply passage with a check valve therein for preventing the fluid from flowing back to the fluid storage portion from the fluid supplied portion and the other of the pair of passages including a second supply passage provided in parallel with the first supply passage, and a switching apparatus for switching the second supply passage to a state in which the fluid can flow in the second supply passage.

2 Claims, 4 Drawing Sheets

FLUID SUPPLY APPARATUS

CROSS REFERENCE TO RELATED APPLICATIONS

This application is based on and claims priority under 35 U.S.C. § 119 to Japanese Patent Application 2005-081333, filed on Mar. 22, 2005, the entire content of which is incorporated herein by reference.

FIELD OF THE INVENTION

This invention generally relates to a fluid supply apparatus. More particularly, this invention pertains to a fluid supply apparatus for supplying a fluid from a fluid storage portion to a fluid supplied portion.

BACKGROUND

JP2001-289014A (document 1) describes a fluid supply apparatus for supplying a fluid from a fluid storage portion to a fluid supplied portion. In the document 1, a valve timing control apparatus for an engine of a vehicle is taken as an example of the fluid supplied portion. The valve timing control apparatus controls a rotational phase angle of a camshaft, which operates an intake/exhaust valve of an engine, relative to an engine crankshaft for controlling intake/exhaust valve timing on the basis of the amount of a fluid supplied by the fluid supply apparatus. In the case where a fluid pressure rises because of counter force from the cam or the like, the fluid tends to leak into a lubrication passage for a crankshaft, a connecting rod, a piston, or the like, or the fluid tends to flow back to an oil pan side. As a result, the valve timing control apparatus is lead to a deficiency in the fluid. For overcoming this, according to the document 1, a check valve is provided for preventing the fluid from flowing back to the fluid storage portion side from the fluid supplied portion side. By doing so, even when the fluid pressure rises in the valve timing control apparatus, a probability of a phenomenon in which the fluid leaks into the lubrication passage or a phenomenon in which the fluid flows back to the oil pan side can be reduced.

However, according to the document 1, because the check valve is provided in a fluid supply passage between the fluid supplied portion and the fluid storage portion, when a temperature of the fluid is low and viscosity of the fluid is high, for example, when an engine starts operation while the engine is cold, pass resistance of the fluid rises in the fluid supply passage. Accordingly, there are adverse effects that the fluid cannot sufficiently supplied to the fluid supplied portion from the fluid storage portion, and that the valve timing control apparatus (fluid supplied portion) cannot start operation properly.

A need thus exists for a fluid supply apparatus, which can supply a fluid to a fluid supplied portion with reliability even when viscosity of the fluid is relatively high. The present invention has been made in view of the above circumstances and provides such a fluid supply apparatus.

SUMMARY OF THE INVENTION

According to an aspect of the present invention, a fluid supply apparatus includes a fluid pump for supplying a fluid to a fluid supplied portion from a fluid storage portion, a pair of passages provided between the fluid storage portion and the fluid supplied portion in series with the fluid pump, one of the pair of passages including a first supply passage with a check valve therein for preventing the fluid from flowing back to the fluid storage portion from the fluid supplied portion and the other of the pair of passages including a second supply passage provided in parallel with the first supply passage, and a switching apparatus for switching the second supply passage to a state in which the fluid can flow in the second supply passage.

BRIEF DESCRIPTION OF THE DRAWINGS

The foregoing and additional features and characteristics of the present invention will become more apparent from the following detailed description considered with reference to the accompanying drawings, wherein.

DETAILED DESCRIPTION

Figure 1:
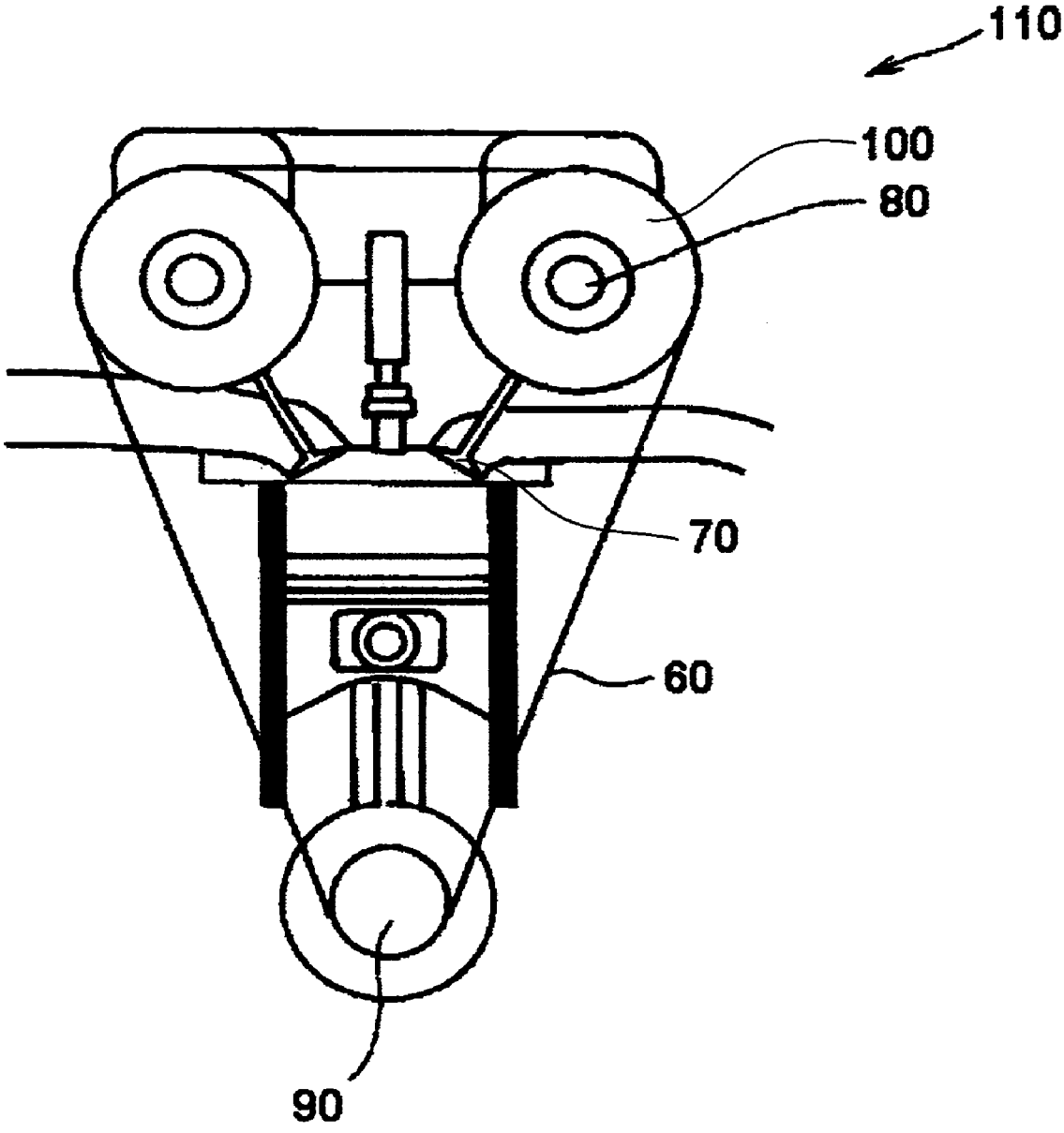
FIG. 1 represents a diagram illustrating an example of a valve timing control apparatus for an engine of a vehicle to which a fluid supply apparatus according to an embodiment of the present invention can be applied.
Figure 2:
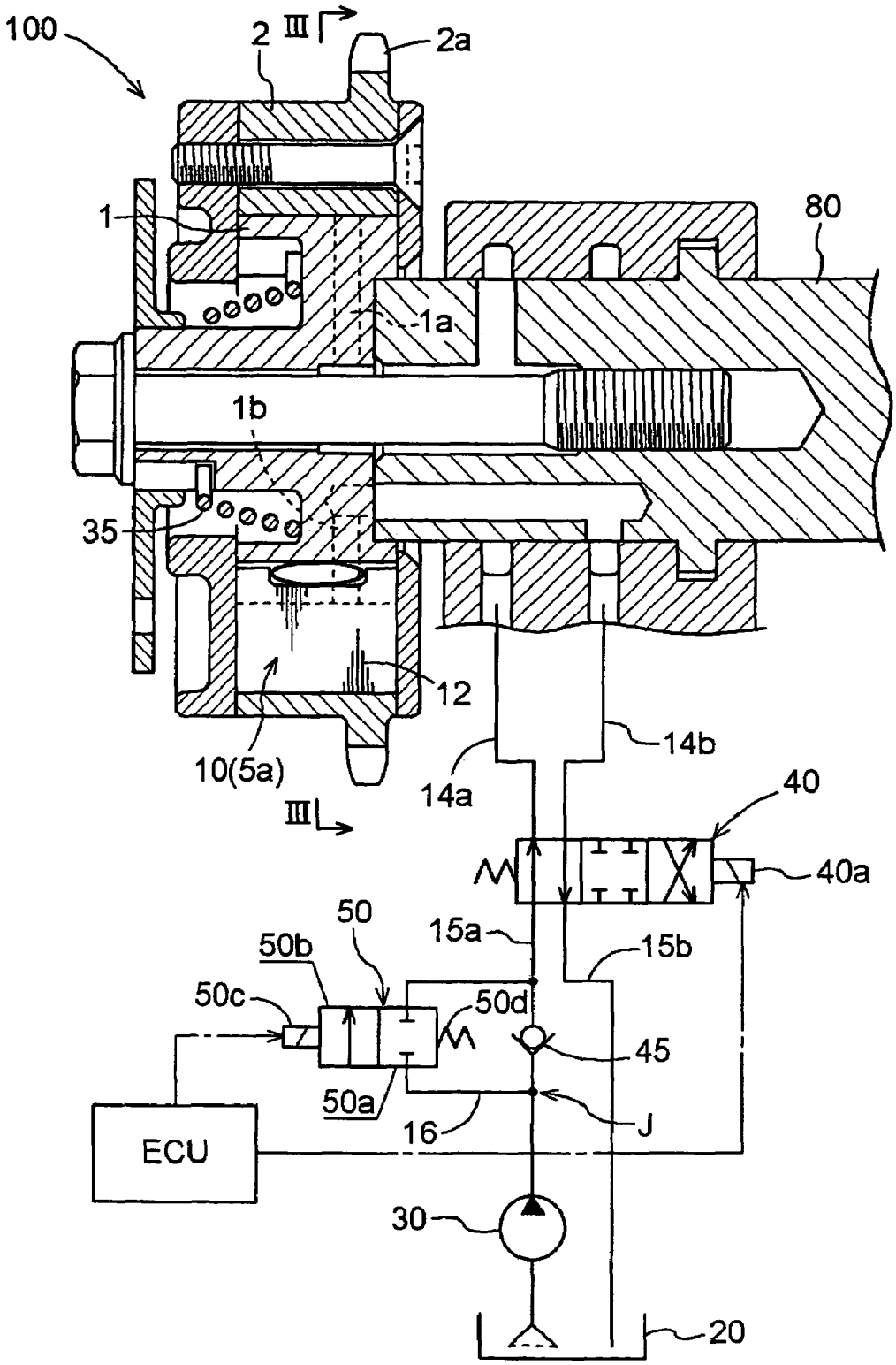
FIG. 2 represents a side view illustrating the fluid supply apparatus according to the embodiment of the present invention.

An embodiment of the present invention will be explained with reference to drawing figures. A fluid supply apparatus according to the embodiment will be explained taking an example in which the fluid supply apparatus is applied to a valve timing control apparatus (fluid supplied portion) for an engine of a vehicle. FIG. 1 represents a diagram illustrating an example of the valve timing control apparatus 100 for the engine 110 of the vehicle to which the fluid supply apparatus according to the embodiment of the present invention can be applied. The valve timing control apparatus 100 controls a rotational phase angle of a camshaft 80, which operates an intake/exhaust valve 70 of the engine 110, relative to a crankshaft 90 for controlling a valve timing on the basis of the amount of a fluid supplied by the fluid supply apparatus. FIG. 2 represents a diagram illustrating an example of the fluid supply apparatus according to the embodiment of the present invention. The valve control apparatus 100 includes a rotor 1 and a housing 2 relatively rotatable to the rotor 1. The rotor 1 is secured to a camshaft 80 of the engine 110 of the vehicle. A sprocket portion 2*a* is provided at an outer peripheral portion of the housing 2. The housing 2 is rotated by the crankshaft 90 through a timing belt 60 put on the sprocket portion 2*a*.

Figure 3:
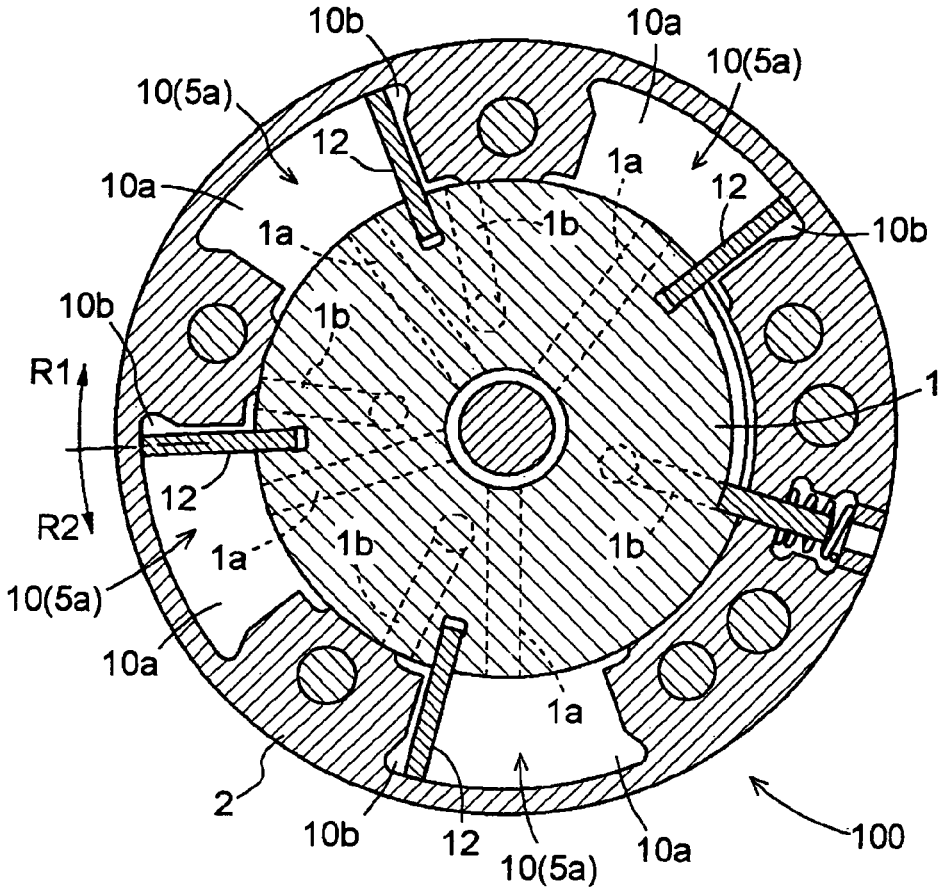
FIG. 3 represents an arrow view of a valve timing control apparatus as seen from an arrow III-III in FIG. 2.

As illustrated in FIG. 3, plural recessed portions 5*a* are provided in an inner peripheral side of the housing 2. The recessed portions 5*a* and an outer peripheral surface of the rotor 1 configure plural fluid chambers 10 which receive a fluid for control, which will be described below. Plural vanes 12 of a plate shape are provided at the outer peripheral surface of the rotor 1. Each fluid chamber 10 is divided into an advanced angle chamber 10*a* and a retarded angle chamber 10*b* by each vane 12. An advanced angle fluid passage 1*a* communicating with each advanced angle chamber 10*a* and a retarded angle fluid passage 1*b* communicating with each retarded angle chamber 10*b* are formed in the rotor 1.

The advanced angle fluid passage 1*a* and the retarded angle fluid passage 1*b* are formed in the rotor 1 to penetrate the rotor 1 in a radial direction. The advanced angle fluid passages 1*a* and an advanced angle fluid passage 14*a* merge in the camshaft 80 located at a center side of the rotor 1. The retarded angle fluid passages 1*b* and a retarded angle fluid passage 14*b* merge in the camshaft 80 located at a center side of the rotor 1. The advanced angle fluid passage 14*a* and the retarded angle fluid passage 14*b* communicate with an oil pan 20 (example of an fluid storage portion) of the engine 110 through a switching control valve 40 operated by a solenoid 40*a*.

Between the oil pan 20 and the switching control valve 40, a first supply passage 15*a* for supplying a fluid to the valve timing control apparatus 100 from the oil pan 20 and a discharge passage 15*b* in which the fluid flows back to the oil pan 20 from the valve timing control apparatus 100 are provided. Between the switching control valve 40 in the first supply passage 15*a* and the oil pan 20, a fluid pump 30 is provided. The fluid pump 30 supplies the fluid stored in the oil pan 20 to the valve timing control apparatus 100.

Positions of the switching control valve 40 are changeable by the solenoid 40*a* in a horizontal direction as seen in FIG. 2. The positions of the switching control valve 40 can move horizontally between a first position seen in FIG. 2, and a second position, and a third position. At the first position, the fluid is supplied to the advanced angle chamber 10*a* from the fluid pump 30 through the advanced angle fluid passage 14*a*, and is discharged from the retarded angle chamber 10*b* to the oil pan 20 through the retarded angle fluid passage 1*b*. At the second position, a flow of the fluid in the advanced angle fluid passage 1*a* and the retarded angle fluid passage 1*b* is prevented. At the third position, the fluid is supplied to the retarded angle chamber 10*b* from the fluid pump 30 through the retarded angle fluid passage 14*b*, and is discharged from the advanced angle chamber 10*a* to the oil pan 20 through the advanced angle fluid passage 14*a*.

By changing the position of the switching control valve 40, the amount of the fluid supplied to the advanced angle chamber 10*a* and the retarded angle chamber 10*b* from the oil pan 20 can be controlled, and a capacity ratio between the advanced angle chamber 10*a* and the retarded angle chamber 10*b* can be adjusted. By doing so, a position of the vane 12 in each fluid chamber 10 can be controlled, and a rotational phase angle of the rotor 1 relative to the housing 2 can be adjusted. As a result, a rotational phase angle of the camshaft 80 can be adjusted relatively to a rotational phase angle of the crankshaft 90, and a control for adjusting an opening/closing timing of the valve 70 driven by the camshaft 80 can be performed relatively to rotation of the crankshaft 90.

For obtaining optimum valve timing when the engine 110 starts, it is preferable to start the engine 110 while a rotational phase angle of the rotor 1 relative to the housing 2 is locked between a most retarded angle and a most advanced angle (locked position, initial position). For doing so, a helical torsion spring 35 is provided between the rotor 1 and the housing 2 for biasing the rotor 1 to an advanced angle side. In the case where the rotor 1 is located at the retarded angle side when the engine 110 stops, the rotor 1 is introduced to the locked position when the engine 110 starts operation next time.

In the first supply passage 15*a* between the switching control valve 40 and the fluid pump 30, a check valve 45 is provided for preventing a flow of the fluid back to the oil pan 20 side from the valve timing control apparatus 100 side. The check valve 45 plays a role to retain supply of the fluid when the valve timing apparatus 100 is in operation. In other words, the check valve 45 plays a role to retain a state in which the fluid supply passage for supplying the fluid to the valve timing control apparatus 100 are filled with the fluid. Between the check valve 45 and the oil pan 20, flow passages for distributing the fluid to lubrication passages of the crankshaft 90, a connecting rod (not illustrated), a piston (not illustrated), or the like, are provided. The check valve 45 prevents a tendency of a leak of the fluid from the valve timing control apparatus 100 to the lubrication passages when a fluid pressure in the first supply passage 15*a* rises by effect of counter force from a cam.

In the first supply passage 15*a* between the switching control valve 40 and the fluid pump 30, a second supply passage 16 is provided so as to bypass the check valve 45. The second supply passage 16 does not include a check valve. A pair of passages, one of the pair of passages including the first supply passage 15*a* and the other of the pair of passages including the second supply passage 16, and the fluid pump 30 are provided in series. An open/close valve 50 is provided in the second supply passage 16.

A position of the open/close valve 50 is changeable between a closed position and an opened position by a solenoid 50*c*. At the closed position, a blocking portion 50*a* in the open/close valve 50 communicates with the fluid pump 30, and the fluid cannot flow in the second supply passage 16. At the opened position, an opening portion 50*b* in the open/close valve 50 communicates with the fluid pump 30, and the fluid can flow in the second supply passage 16. In other words, the open/close valve 50 serves as an open/close switching apparatus for switching between open/close states of the second supply passage 16. Further, the open/close valve 50 serves as a switching apparatus for switching fluid supply passages between the first supply passage 15*a* and the second supply passage 16.

A temperature sensor (not illustrated) for detecting a temperature of the fluid is provided in the oil pan 20 or an appropriate position in the first supply passage 15*a*. When the temperature detected by the temperature sensor is lower than a predetermined threshold (accordingly, viscosity of the fluid is high), for example, when the engine 110 starts in a cold state, a signal is transmitted from an electronic control unit (ECU) of the vehicle to the solenoid 50*a* to switch the open/close valve 50 (switching apparatus) to the opened position. Accordingly, because the open/close valve 50 becomes the opened position when the temperature of the fluid in the first supply passage 15*a* is low and viscosity of the fluid is high, the fluid from the oil pan 20 bypasses the first supply passage 15*a* including the check valve 45 having large pass resistance, and flows in the second supply passage 16 without a check valve and having small pass resistance. Thus, the fluid can be efficiently supplied to the valve timing control apparatus 100. Accordingly, the valve timing control apparatus 100 can start operation early. It may be possible to utilize a temperature sensor for measuring a temperature of cooling water for cooling a cylinder head of the engine 110 as the temperature sensor described above.

On the other hand, when a temperature detected by the temperature sensor is higher than the predetermined threshold (accordingly, viscosity of the fluid is low), for example, after the engine 110 is warmed up, a position of the open/close valve 50 is changed to the closed position, and the fluid cannot flow in the second supply passage 16. Accordingly, the fluid can flow only in the first supply passage 15*a*. Thus, the check valve 45 can effectively reduce a probability of a phenomenon in which the fluid leaks into the lubrication passage of the crankshaft 90, the connecting rod, the piston, or the like. In the meantime, because the open/close valve 50 is biased by a coil spring 50*d* to the closed position, in case a signal does not transmitted to the solenoid 50*a* from the ECU because of a short or the like, the open/close valve 50 is retained to the closed position by the coil spring 50*d*, and a reduction of a fluid leak can be expected.

Figure 4A:
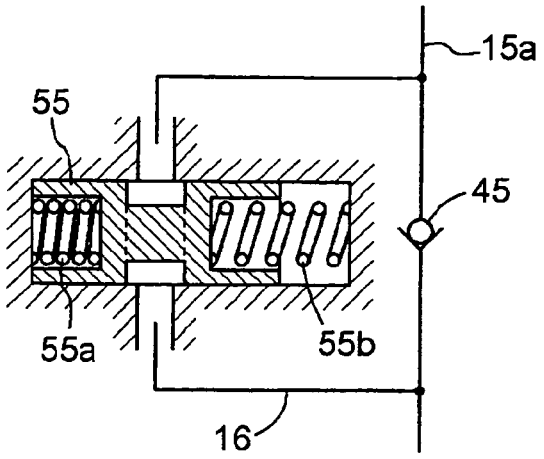
FIGS. 4A and 4B represent schematic diagrams illustrating an open/close valve utilized in a fluid supply apparatus according to an additional embodiment.
Figure 4B:
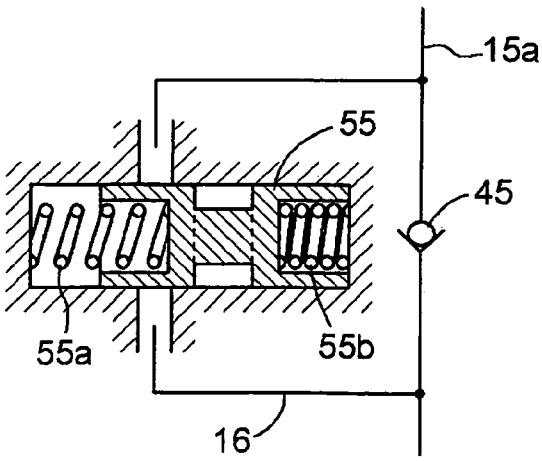

Additional embodiments will be explained. In a first additional embodiment, the second supply passage 16 is not switched by an electric signal transmitted from the ECU of the vehicle on the basis of the temperature of the fluid or cooling water detected by the temperature sensor. In the first additional embodiment, as illustrated in FIGS. 4A and 4B, a bimetal or a shape memory effect alloy driven on the basis of the temperature of the fluid or cooling water can be utilized as an actuator for opening/closing the open/close valve (switching apparatus). In an example illustrated in FIGS. 4A and 4B also, the pair of passages, one of the pair of passages including the first supply passage 15*a* with the check valve 45 and the other of the pair of passages including the second supply passage 16 without a check valve, and the fluid pump are provided in series. A position of the open/close valve 55 provided in the second supply passage 16 can be changed by an operational spring 55*a* made of a shape memory effect alloy in a horizontal direction as seen in FIGS. 4A and 4B. The position of the open/close valve 55 can be changed between an opened position (illustrated in FIG. 4A) and a closed position (illustrated in FIG. 4B). At the opened position, the fluid can flow in the second supply passage 16. At the closed position, the fluid cannot flow in the second supply passage 16.

The operational spring 55*a* is provided in a recessed portion formed at a first side surface of the open/close valve 55, and is located in a flow passage (not illustrated) of the fluid or cooling water. Further, a coil spring 55*b*, as a biasing apparatus, made of a normal metal, not a shape memory effect alloy, is provided in a recessed portion formed at a second side surface of the open/close valve 55 so as to bias the open/close valve 55 to the opened position. When the temperature of the fluid or cooling water is lower than a predetermined threshold, as illustrated in FIG. 4A, the operational spring 55*a* contracts and the open/close valve 55 is retained to be the opened position by effect of biasing force of the coil spring 55*b*. On the other hand, when the temperature of the fluid or cooling water is higher than the predetermined threshold, as illustrated in FIG. 4B, the operational spring 55*a* made of a shape memory effect alloy extends by effect of heat given from the fluid or cooling water, and changes the position of the open/close valve 55 to the opened position against biasing force of the coil spring 55*b*. Instead of the operational spring 55*a* made of a shape memory effect alloy, an actuator made of a bimetal can be utilized.

Figure 5:
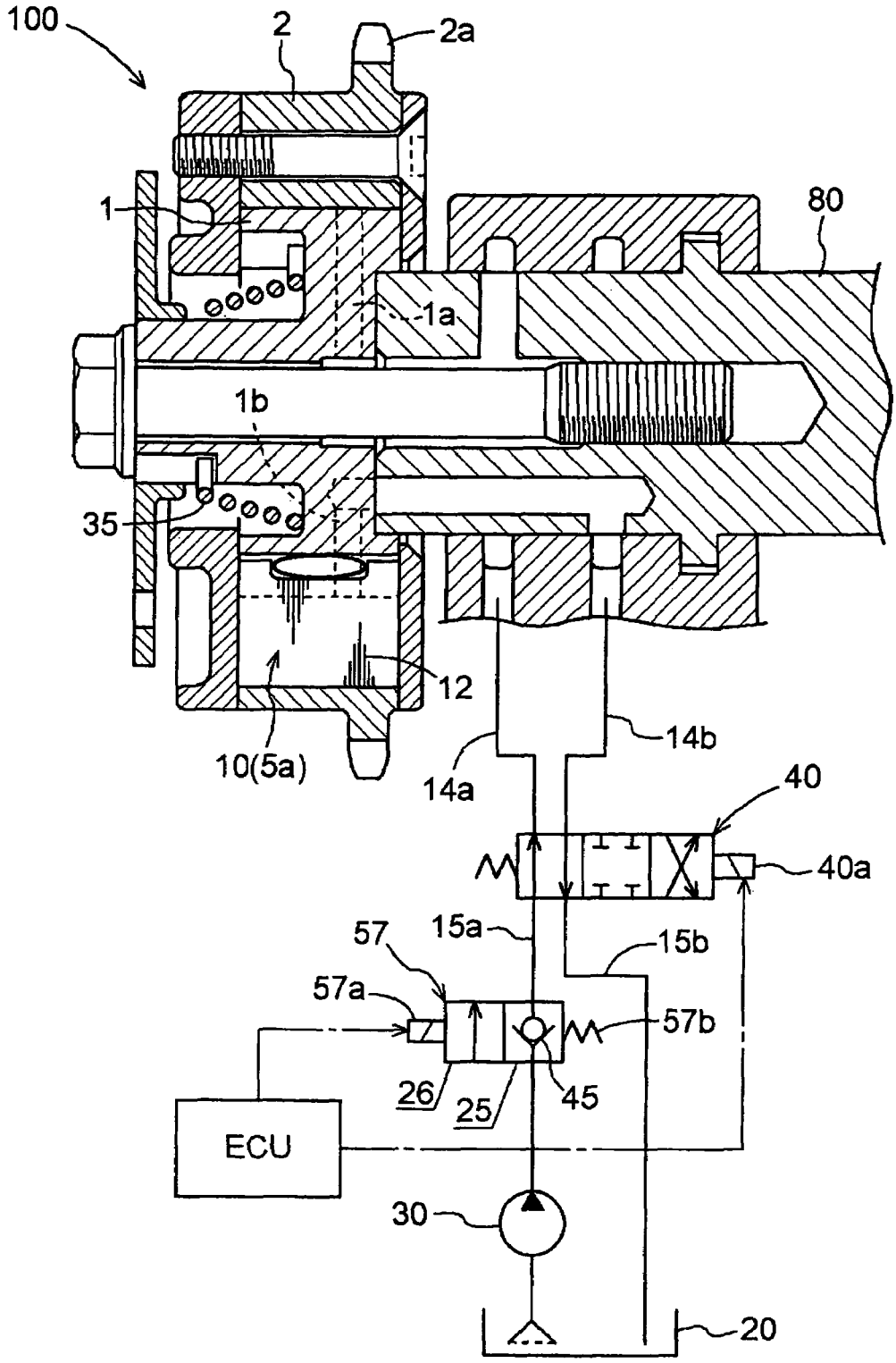
FIG. 5 represents a schematic view illustrating an open/close valve utilized in a fluid supply apparatus according to a further additional embodiment.

A second additional embodiment will be explained. As a switching apparatus for switching the second supply passage without a check valve to a state in which the fluid can flow in the second supply passage, instead of providing a switching apparatus for switching open and close, which switches an open/close state of the second supply passage, a switching apparatus for switching supply passages can be provided, which selectively switches the first supply passage and the second supply passage. Precisely, for example, as illustrated in FIG. 5, an open/close valve 57 including a pair of passages, one of the pair of passages including a first supply passage 25 with a check valve 45 and the other of the pair of passages including a second supply passage 26 without a check valve, and the fluid pump 30 can be provided in series. The position of the open/close valve 57 is changeable in a horizontal direction as seen in FIG. 5, between a first position (illustrated in FIG. 5) and a second position. At the first position, the first supply passage 25 with the check valve 45 communicates with the fluid pump 30. At the second position, the second supply passage 26 without a check valve communicates with the fluid pump 30.

The open/close valve 57 is biased by a coil spring 57*b* to the first position. The position of the open/close valve 57 is changed to the second position by a solenoid 57*a* driven on the basis of a signal transmitted from the ECU. As described above, because the open/close valve 57 is biased to the first position by the coil spring 57*b*, or the like, even in case a signal is not transmitted to the solenoid 57*a* from the ECU because of a short or the like, a reduction of a fluid leak can be expected. In the meantime, an actuator for operating the open/close valve 57 can be a bimetal or a shape memory effect alloy driven on the basis of the temperature of the fluid or cooling water.

A third additional embodiment will be explained. As a switching apparatus for switching supply passages, which selectively switches between the first supply passage 15*a* and the second supply passage 16 illustrated in FIG. 2, a three-way valve located at a branch portion (illustrated in FIG. 2 as J) can be utilized. At the branch portion, the fluid flowing from the oil pan 20 is separated into the first supply passage 15*a* and the second supply passage 16. The three-way valve can be switched by a bimetal or a shape memory effect alloy driven on the basis of the temperature of the fluid. Or, the three-way valve can be switched by an actuator driven on the basis of the temperature of the fluid detected by a temperature sensor.

A fourth additional embodiment will be explained. If the pair of passages, one of the pair of passages including the first supply passage 15*a* with the check valve 45 and the other of the pair of passages including the second supply passage 16 without a check valve, is not provided between the switching control valve 40 and the fluid pump 30 as described in the embodiment of the present invention, but between the oil pan 20 and the fluid pump 30, the same effect can be obtained.

A fifth additional embodiment will be explained. Switching operation of the second supply passage 16 can be performed not always on the basis of viscosity of the fluid detected on the basis of the detected temperature of the fluid or cooling water. Switching operation of the second supply passage 16 can be performed also on the basis of the rotational phase angle of the camshaft 80 relative to the crankshaft 90 set by the valve timing control apparatus 100, which determines a valve timing relative to rotation of the crankshaft 90. For example, when a rotational phase angle of the camshaft 80 relative to the crankshaft 90 is within a predetermined range, in other words, a valve timing relative to the rotation of the crankshaft 90 is within a predetermined range, a switching apparatus can switch the second supply passage 16 so that the fluid cannot flow in the second supply passage 16.

In other words, when an actual rotational phase angle of the camshaft 80 relative to the crankshaft 90 is not stable relatively to a target rotational phase angle of the camshaft 80 relative to the crankshaft 90 in the valve timing control apparatus 100, the fluid tends to leak easily. Accordingly, the switching apparatus switches the second supply passage 16 so that the fluid cannot flow in the second supply passage 16 and so that the fluid can flow only in the first supply passage 15*a* with the check valve 45. By doing so, a fluid leak can be effectively reduced and the stability described above can be retrieved immediately. Here, the target rotational phase angle of the camshaft 80 relative to the crankshaft 90 can be determined on the basis of a valve timing assumed to be optimum for a rotational speed of the crankshaft 90 at this time. In other words, the target rotational phase angle of the camshaft 80 relative to the crankshaft 90 represents an optimum rotational phase angle difference between the camshaft 80 and the crankshaft 90, in other words, an optimum rotational phase angle difference between a cam and a crank. The actual rotational phase angle of the camshaft 80 relative to the crankshaft 90 represents an actual rotational phase angle difference between the camshaft 80 and the crankshaft 90, in other words, an actual rotational phase angle difference between the cam and the crank. Further, the term "stability is high" represents that frequency of a deviation of the actual rotational phase angle of the camshaft 80 relative to the crankshaft 90 from a permissible zone of the target rotational phase angle of the camshaft 80 relative to the crankshaft 90, provided as a map in the ECU, is low. The actual rotational phase angle of the camshaft 80 relative to the crankshaft 90 can be obtained by comparing a cam angle detected by a cam angle sensor with a crank angle detected by a crank angle sensor.

A sixth additional embodiment will be explained. Generally, when the engine 110 starts operation, the rotational phase angle of the camshaft 80 relative to the crankshaft 90 set by the valve timing control apparatus 100 comes to an initial position by effect of the helical torsion spring 35. However, if it is judged that the rotational phase angle of the camshaft 80 relative to the crankshaft 90 set by the valve timing control apparatus 100 is not at the initial position when the engine 110 starts operation because of some unexpected reasons, the ECU of the vehicle can transmit a signal for switching the open/close valve 50 (switching apparatus) to a closed state. By doing so, the fluid cannot flow in the second supply passage 16, and can flow only in the first supply passage 15*a* with the check valve 45. Accordingly, when the fluid is supplied from the fluid pump 30, the fluid can be supplied into the advanced angle chamber 10*a* through the check valve 45 and the rotational phase angle of the camshaft 80 relative to the crankshaft 90 set by the valve timing control apparatus 100 can reach an initial position early. Thus, smooth start of the engine 110 can be promoted.

A seventh additional embodiment will be explained. A fluid supply apparatus according to the embodiment of the present invention can be applied to a working fluid supplied portion such as a valve timing control apparatus for an engine of a vehicle. Further, the fluid supply apparatus according to the embodiment of the present invention can be applied to a lubrication fluid supply portion for supplying a lubrication fluid to some parts of an engine.

According to the embodiments of the present invention, a fluid supply apparatus, including a fluid pump for supplying a fluid from a fluid storage portion to a fluid supplied portion, such as a valve timing control apparatus, can be improved so that the fluid supplied portion can easily start operation even in a condition in which viscosity of the fluid is relatively high.

According to a first aspect of the present invention, a fluid supply apparatus includes a fluid pump for supplying a fluid to a fluid supplied portion from a fluid storage portion, a pair of passages provided between the fluid storage portion and the fluid supplied portion in series with the fluid pump, one of the pair of passages including a first supply passage with a check valve therein for preventing the fluid from flowing back to the fluid storage portion from the fluid supplied portion and the other of the pair of passages including a second supply passage provided in parallel with the first supply passage, and a switching apparatus for switching the second supply passage to a state in which the fluid can flow in the second supply passage.

According to the aspect of the present invention, even when viscosity of the fluid is high, the fluid can flow in the second supply passage without a check valve. Accordingly, the fluid can be efficiently supplied to the fluid supplied portion. On the other hand, in a situation where viscosity of the fluid is low and the fluid tends to easily leak from the supply passage, the second supply passage can be closed so that the fluid cannot flow in the second supply passage. In this case, the fluid can flow only in the first supply passage with the check valve. Accordingly, a probability of a fluid leak can be lowered.

According to a second aspect of the present invention, the switching apparatus includes an open/close switching apparatus for switching the second supply passage between open and close states.

According to the aspect of the present invention, by switching the open/close state of the second supply passage, the second supply passage can be switched between states where the fluid can flow or cannot flow therein. Accordingly, a supply passage from the fluid storage portion to the fluid supplied portion through the first supply passage can be obtained at any time. As a result, even when the switching apparatus of the second supply passage does not operate well, a minimum amount of the fluid in necessity can be supplied through the first supply passage. Accordingly, high reliability of the fluid supply apparatus can be ensured.

According to a third aspect of the present invention, the switching apparatus switches the second supply passage between open and close states on the basis of a temperature of the fluid.

The temperature of the fluid highly effects viscosity of the fluid. According to the aspect of the present invention, because the switching apparatus is operated on the basis of the temperature of the fluid, flow condition of the fluid can be properly controlled.

According to a fourth aspect of the present invention, the switching apparatus includes a bimetal or a shape memory effect alloy driven on the basis of the temperature of the fluid.

According to the aspect of the present invention, because the bimetal or the shape memory effect alloy driven on the basis of the temperature of the fluid is utilized, even when a temperature sensor for detecting a temperature of the fluid or cooling water and a control apparatus for actuating an actuator on the basis of the temperature detected by the temperature sensor are not provided, the switching apparatus can be switched on the basis of the temperature of the fluid. Accordingly, a simple fluid supply apparatus can be obtained.

According to a fifth aspect of the present invention, the fluid supplied portion includes a valve timing control apparatus for an engine of a vehicle for controlling a rotational phase angle of a camshaft relative to a crankshaft for controlling an intake/exhaust valve timing and wherein the switching apparatus switches the second supply passage to a state in which the fluid cannot flow in the second supply passage when the rotational phase angle of the camshaft relative to the crankshaft is within a predetermined range.

When phase control of the camshaft cannot follow change of the rotational phase angle of the crankshaft, in other words, when an actual rotational phase angle of the camshaft relative to the crankshaft is deviated widely from a target rotational phase angle of the camshaft relative to the crankshaft, and the valve timing apparatus is in an unstable state, a fluid leak tends to increase. In this case, according to the aspect of the present invention, the fluid supply passage is switched to the first supply passage with the check valve therein. Accordingly, the leak of the fluid can be reduced and the amount of the fluid in the valve timing control apparatus can be obtained with reliability.

According to a sixth aspect of the present invention, the fluid supplied portion includes a valve timing control apparatus for an engine of a vehicle for controlling a rotational phase angle of a camshaft relative to a crankshaft for controlling an intake/exhaust valve timing and wherein the switching apparatus switches the second supply passage to a state in which the fluid cannot flow in the second supply passage when the rotational phase angle of the camshaft relative to the crankshaft is out of an initial position at the time of starting the engine.

According to the aspect of the present invention, when the engine cannot smoothly start operation because the rotational phase angle of the camshaft relative to the crankshaft is not at an initial position at the time of starting the engine because of some unexpected reasons, the second supply passage is closed so that the fluid cannot flow in the second supply passage and the fluid supply passage is limited only to the first supply passage with the check valve. By doing so, the fluid can be supplied to an advanced angle fluid passage through the check valve. Accordingly, the rotational phase angle of the camshaft relative to the crankshaft (rotational phase angle of the valve timing control apparatus) can move back to an initial position, and a smooth engine start can be promoted.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. A fluid supply apparatus, comprising:

a fluid pump for supplying a fluid to a fluid supplied portion from a fluid storage portion;

a pair of passages provided between the fluid storage portion and the fluid supplied portion in series with the fluid pump, one of the pair of passages including a first supply passage with a check valve therein for preventing the fluid from flowing back to the fluid storage portion from the fluid supplied portion and the other of the pair of passages including a second supply passage provided in parallel with the first supply passage; and a switching apparatus for switching the second supply passage to a state in which the fluid can flow in the second supply passage, wherein the fluid supplied portion includes a valve timing control apparatus for an engine of a vehicle for controlling a rotational phase angle of a camshaft relative to a crankshaft for controlling an intake/exhaust valve timing and wherein the switching apparatus switches the second supply passage to a state in which the fluid cannot flow in the second supply passage when the rotational phase angle of the camshaft relative to the crankshaft is within a predetermined range.

2. A fluid supply apparatus, comprising:

a fluid pump for supplying a fluid to a fluid supplied portion from a fluid storage portion;

a pair of passages provided between the fluid storage portion and the fluid supplied portion in series with the fluid pump, one of the pair of passages including a first supply passage with a check valve therein for preventing the fluid from flowing back to the fluid storage portion from the fluid supplied portion and the other of the pair of passages including a second supply passage provided in parallel with the first supply passage; and a switching apparatus for switching the second supply passage to a state in which the fluid can flow in the second supply passage, wherein the fluid supplied portion includes a valve timing control apparatus for an engine of a vehicle for controlling a rotational phase angle of a camshaft relative to a crankshaft for controlling an intake/exhaust valve timing and wherein the switching apparatus switches the second supply passage to a state in which the fluid cannot flow in the second supply passage when the rotational phase angle of the camshaft relative to the crankshaft is out of an initial position at the time of starting the engine.

* * * * *